US005554048A

United States Patent [19]

Martins

[11] Patent Number: 5,554,048

[45] Date of Patent: Sep. 10, 1996

[54] INSULATION DISPLACING BARREL CONTACT

[75] Inventor: Crisostomo Martins, Carignano, Italy

[73] Assignee: The Whitaker Corporation, Wilmington, Del.

[21] Appl. No.: 345,673

[22] Filed: Nov. 28, 1994

[30] Foreign Application Priority Data

Dec. 22, 1993 [GB] United Kingdom ..... 9326230

[51] Int. Cl.[6] ..... H01R 4/24

[52] U.S. Cl. ..... 439/406; 439/395

[58] Field of Search ..... 439/395, 406, 439/409, 411, 413, 417, 401, 398

[56] References Cited

U.S. PATENT DOCUMENTS 4,141,618 2/1979 Reavis, Jr. et al. ..... 439/406
4,343,529 1/1980 Reavis, Jr. et al. ..... 339/198 R
4,897,040 1/1990 Gerke et al. ..... 439/401

FOREIGN PATENT DOCUMENTS 0348066 12/1989 European Pat. Off. .
2419594 10/1979 France .
WO93/07655 4/1993 WIPO .

*Primary Examiner*—David L. Pirlot
*Assistant Examiner*—Brian J. Biggi
*Attorney, Agent, or Firm*—Driscoll A. Nina

[57] ABSTRACT

An improved barrel-shaped IDC contact comprises a cylindrical body section having a longitudinal IDC slot formed by opposed edges. Extending longitudinally alongside the edges are cutouts forming a resilient beam section therebetween in order to increase the resiliency of the IDC slot. The latter reduces degradation of the contact by stress relaxation. The cutouts also provide better access of plating fluids to the interior of the barrel thereby improving penetration thereof and allowing the plating line to run faster. The design is therefore more cost-effective.

17 Claims, 1 Drawing Sheet

INSULATION DISPLACING BARREL CONTACT

BACKGROUND OF THE INVENTION

1. Field of the Invention

This invention relates to an improved barrel-shaped insulation displacing contact (IDC) for making electrical contact to conducting wires.

2. Description of the Prior Art

Barrel-shaped insulation displacing contacts are already known and shown for example in U.S. Pat. No. 3,863,318, whereby such contacts procure a number of advantages with respect to other IDC designs such as ease of manufacturing, an improved ability to accommodate conductors of different sizes, and good mechanical and electrical properties. Additionally, barrel-shaped IDC's are well adapted to mass termination i.e. a plurality of conducting wires can be simultaneously connected to the plurality of barrel-shaped IDC's in a simple, reliable and cost-effective manner.

In order to further improve the reliability and the cost-effectiveness of barrel-shaped IDC contacts, it would be desirable to increase the flexibility of the contacting edges of the IDC slots, in particular to decrease degradation of the contact pressure between the conducting wire and edges of the IDC slots caused by stress relaxation. Stress relaxation is caused by creep which is a permanent material displacement, the rate of which is a function of the temperature and stress within the material. By increasing the flexibility of the IDC contacts, stress within the contact is reduced, therefore reducing stress relaxation. In order to reduce the manufacturing cost, it would also be desirable to provide good access, during the plating procedure, to the inside of the barrel contact as the plating procedure can then be accelerated. The functional contact surfaces of IDC's i.e. the contact edges, are commonly plated in order to reduce contact corrosion which increases the electrical resistance between the conducting wire and IDC terminal, whereby not only the actual contact edge must be plated but also the surrounding surfaces as the corrosion "overflows". The latter is also to ensure that a sufficient plating thickness is achieved, to avoid excessive porosity of the plating layer.

SUMMARY OF THE INVENTION

It is therefore an object of this invention to provide a barrel-shaped insulation displacing contact that has improved stress relaxation characteristics.

It is a further object of this invention to provide a barrel-shaped insulation displacing contact with reduced manufacturing time.

It is a further object of this invention to provide a cost-effective and reliable insulation displacing contact.

The objects of this invention have been achieved by providing a barrel-shaped insulation displacing contact (IDC) comprising a longitudinally extending barrel-shaped body section stamped and formed from sheet metal, and a longitudinal IDC slot formed by opposing IDC edges of a seam of the body section, whereby at least one cutout is provided proximate one of the edges so as to form a flexible beam between the cutout and the edge, thereby increasing the flexibility of the IDC slot with respect to a conducting wire stuffed therein adjacent the beam section.

DETAILED DESCRIPTION OF THE PREFERRED EMBODIMENT

Figure 1:
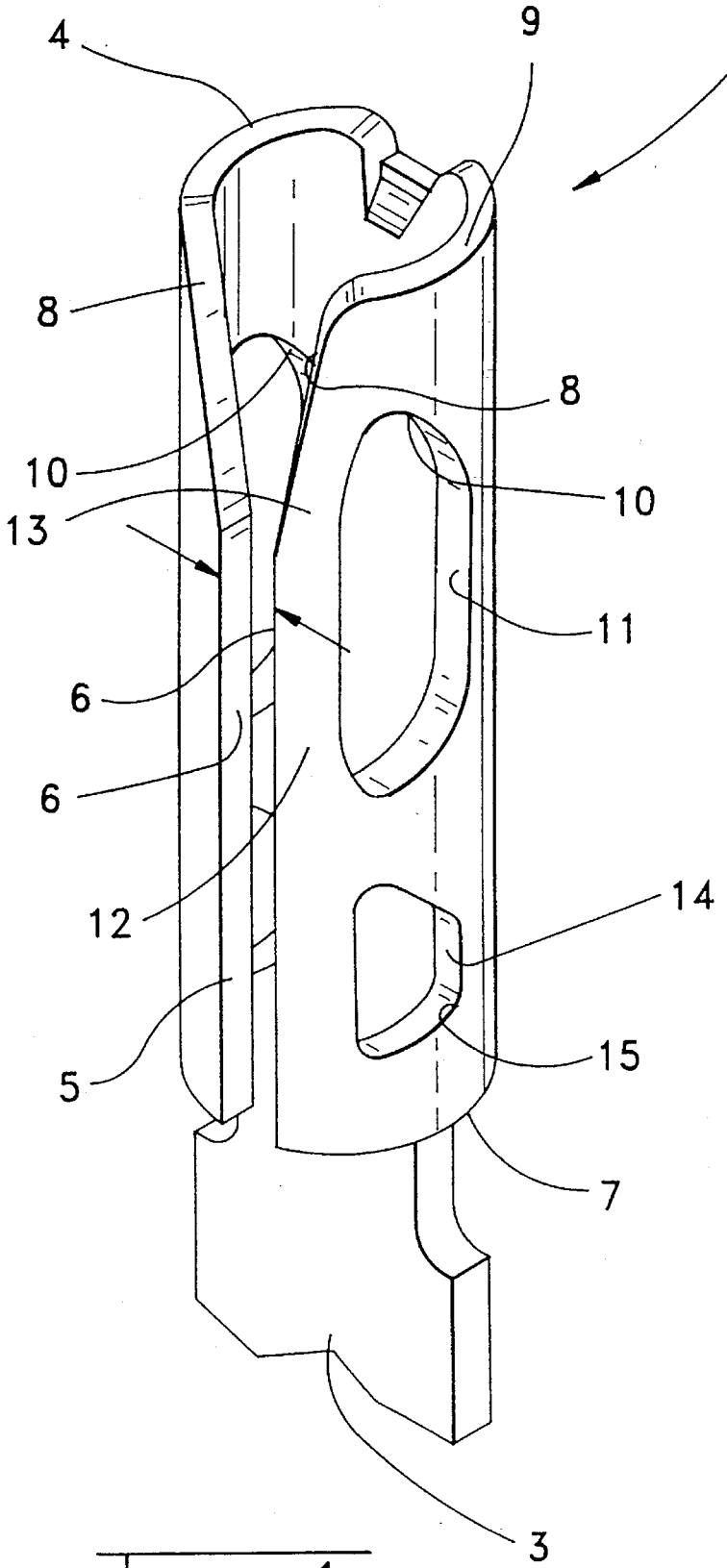
FIG. 1 is a perspective view of a barrel-shaped insulation displacing contact (IDC) according to this invention.

Referring to the FIG. 1, an insulation displacing contact 2 is shown comprising a longitudinally disposed, substantially cylindrical body section 4 extending between a wire receiving end 9 and a terminal end 7, the contact 2 stamped and formed from sheet metal, the body section folded together from the sheet metal base so that it's seam forms a longitudinal IDC slot 5 having opposed IDC edges 6 extending into a Y-shaped diverging entry section 8 that ends at the wire receiving end 9 of the contact 2. From the terminal end 7, extends a terminal section (3) (only partially shown) for mating to a complementary conductor (not shown).

The body section 4 is provided with longitudinally disposed oblong cutouts 10 alongside and spaced from the opposed IDC edges 6 such that a flexible beam member 12 is formed therebetween. Further cutouts 14 are provided between the first cutouts 10 and the terminal body end 7. Both the cutouts 10 and 14 have fully closed peripheral edges 11, 15 respectively.

The cutouts 10 increase the flexibility of the IDC slot 5 with respect to a conducting wire stuffed between the opposed IDC edges 6 adjacent the beams 12, due to the resiliency not only of the barrel-shaped body section 4 which bends open, but also the resilient bending of the beams 12. Due to the greater flexibility, stresses within the body section 4 are well distributed, enabling the body section 4 to contain more elastic energy whilst decreasing stress relaxation due to creep when comparing to a barrel-shaped IDC contact not comprising the cutouts 10 and resilient beam section 12. The cutouts 10 extend longitudinally beyond the opposed IDC edges 6 and alongside the Y-shaped entry section 8 in order to increase the flexibility of the IDC slot 5 during stuffing of the wire therein so as to avoid having excessive pressure on the conducting strands of the wire during entry into the IDC slot opposed edges 6. Excessive pressure could damage the conducting strands by cutting thereinto, thereby reducing the contact pressure between the edges 6 and conducting strands once fully inserted.

The holes 10 and 14 also have the functional reducing manufacturing costs by allowing a more efficient penetration and distribution of the plating inside the body section 4. During the plating procedure a plurality of IDC contacts 2 are joined together via a carrier strip and run through various plating baths in a continuous line process. The speed of this process is determined, inter alia by the time during which the contact 2 must remain immersed in the plating baths in order to have sufficient deposit of the plating metal concerned (for example nickel) on the functional zones of the contact. In order to avoid corrosion "overflowing" onto the contact zones, plating must be deposited not only on, but also around the opposed IDC edges 6 of the slot 5. This means that not only the outer surface of the barrel body section 4 but also the inner surface requires controlled and sufficient plating of the plating metal(s). The holes 10 and 14 improve the quality of plating inside the barrel-shaped body section 4 and also increase the plating speed due to the more efficient penetration and greater flow of the electrolytic plating fluid therein.

Advantageously therefore, the cutouts alongside the IDC slot 5 in the barrel-shaped contacts 2 provide firstly for a more cost-effective terminal due to the reduced time required for plating, and secondly for a more reliable contact with less risk of degradation caused by stress relaxation.

I claim:

1. A barrel-shaped insulation displacing contact (IDC) stamped and formed from sheet metal comprising a barrel-shaped body section extending longitudinally between a wire receiving end and a terminal end, the body section comprising a longitudinally disposed IDC slot formed by a pair of spaced-apart opposed IDC edges of a seam of the body-section arising from folding together thereof from the sheet metal, the contact characterized in that at least one elongated closed perimeter cutout having closed ends having a generally arcuate surface is provided in the body-section along side and spaced from one of the opposed IDC edges to form a resilient beam therebetween.

2. The contact of claim 1 characterized in that the cutout has an oblong shape extending substantially in the longitudinal direction.

3. The contact of claims 1 or 2 characterized in that the IDC slot extends divergingly into a wire entry section which extends to the wire receiving end.

4. The contact of claim 3 characterized in that the cutout extends beyond the IDC slot and alongside the wire entry section to form a resilient member therebetween.

5. The contact of claim 1 characterized in that there are further cutouts in the body section disposed between the cutouts and the terminal end.

6. The contact of claim 1 characterized in that there are a pair of the cutouts, each proximate a corresponding opposed IDC edge.

7. The contact of claim 1 characterized in that the at least one cutout has a completely closed peripheral edge.

8. The contact of claim 5 characterized in that there are a pair of the further cutouts.

9. A barrel shaped insulation displacing contact (IDC) comprising:

a barrel shaped body section extending longitudinally between a wire receiving end and a terminal end;

a longitudinally disposed IDC slot having a pair of spaced-apart opposed IDC edges, the IDC slot being formed in the barrel-shaped section; and, a resilient beam carrying a portion of one of the IDC edges, said resilient beam being formed by a closed perimeter elongated cutout having closed ends having a generally arcuate surface in the body section that is located alongside and spaced from the IDC edge.

10. The contact of claim 9, wherein the another resilient beam is formed carrying the other of the IDC edges.

11. The contact of claim 10, wherein the other resilient beam is formed by another cut out and each cut out is defined by a closed perimeter edge.

12. The contact of claim 11, wherein a second set of cut outs are disposed between the cutouts that form the resilient beam and the terminal end.

13. The contact of any one of claims 10–12, wherein the barrel shaped body section is symmetrical about the IDC slot.

14. A barrel shaped insulation displacing contact (IDC) comprising a generally tubular body section extending longitudinally from a wire receiving end to a terminal end, the tubular body section including an IDC slot extending longitudinally therein where the IDC slot is formed by a pair of spaced apart IDC edges, the contact further including a pair of closed perimeter edge cutouts of oval shape in the body section where each cutout is disposed along side and spaced from a different one of the opposed IDC edges such that a deflectable beam is formed between the cutout and the IDC edge.

15. The contact of claim 14, wherein the IDC slot extends divergingly into a wire entry section at the wire receiving end and the closed perimeter of the cutout extends alongside and spaced therefrom such that the resilient beam is extended therealong.

16. The contact of claim 14, wherein the tubular body section includes additional opening therein.

17. The contact of any one of claims 14–16, wherein the tubular body is symmetrical about the longitudinally extending IDC slot.

* * * * *